US006869306B1

(12) United States Patent
Sung

(10) Patent No.: US 6,869,306 B1
(45) Date of Patent: Mar. 22, 2005

(54) SERIAL ATA INTERFACE CONNECTOR

(76) Inventor: Yun-Ching Sung, No. 53-2, Community 6, Chih Pa Sub-Ward, ChungLi City, TaoYuan Hsien (TW)

( * ) Notice: Subject to any disclaimer, the term of this patent is extended or adjusted under 35 U.S.C. 154(b) by 0 days.

(21) Appl. No.: 10/761,282

(22) Filed: Jan. 22, 2004

(51) Int. Cl.[7] ..... H01R 9/07
(52) U.S. Cl. ..... 439/449
(58) Field of Search ..... 439/397, 399, 439/404, 405, 443, 499, 877

(56) References Cited

U.S. PATENT DOCUMENTS 5,226,835 A * 7/1993 Baker et al. ..... 439/403
5,643,005 A * 7/1997 Weidler et al. ..... 439/405
5,820,404 A * 10/1998 Chishima et al. ..... 439/417
5,911,594 A * 6/1999 Baker et al. ..... 439/404
6,790,075 B1 * 9/2004 Sung ..... 439/499

* cited by examiner

*Primary Examiner*—Thanh-Tam Le
(74) *Attorney, Agent, or Firm*—Rosenberg, Klein & Lee

(57) ABSTRACT

A Serial ATA interface connector includes a connector body holding a set of terminals of two different lengths alternatively arranged in parallel, each terminal having a vertically extended conductor holder defining a Y-shaped retaining notch, a Serial ATA interface cable having conductors respectively fastened to the Y-shaped retaining notches of the conductors, a bottom cover shell and a top cover shell fastened together by a hook joint to hold down the connection between the conductors of the Serial ATA interface cable and the conductor holders of the terminals, connector body having top and bottom locating blocks respectively engaged into respective locating holes in the top and bottom cover shells, the holes of the top and bottom cover shells being kept from sight after connection between the top and bottom cover shells.

2 Claims, 9 Drawing Sheets

SERIAL ATA INTERFACE CONNECTOR

BACKGROUND OF THE INVENTION

1. Field of the Invention

The present invention relates to a SATA (Serial AT Attachment) interface connector and, more particularly, to such a SATA interface connector, which keeps the conductors of the SATA interface cable positively connected to the conductors in the connector body without solder.

2. Description of the Related Art

FIG. 1 illustrates a conventional bus line connector for use in computer. This design of bus line connector requires much installation space because the bus line 11 is comprised of more than seventy signal lines arranged in parallel. Therefore, various Serial ATA interface connectors are developed. Serial ATA is the next generation storage interface standard for personal computer designed to replace the Ultra ATA parallel interconnect cable (80 conductors) with a much smaller, more flexible serial design. FIGS. 2A and 2B show a Serial ATA interface connector according the prior art. According to this design, the Serial ATA interface connector comprises a connector body 13, a plurality of terminals 14 mounted in the connector body 13, a Serial ATA interface cable 15 having conductors 151 respectively soldered to the terminals 14, and an electrically insulative outer shell 16 molded on a part of the connector body 13 and a part of the Serial ATA interface cable 15. This design of Serial ATA interface connector has drawbacks as follows:

1. It consumes much time to solder the conductors 151 to the terminals 14 by labor. When soldering the conductors 151 to the terminals 14, toxic waste gas is produced.

2. The conductors 151 are thin wire conductors and the two conductors on the middle are commonly soldered to a common terminal, improper soldering affects the electric properties of the connector.

3. When molding the electrically insulative outer shell 16, the molding pressure may distort the conductors 151, resulting in a short circuit.

FIG. 2C shows a prior art Serial ATA interface connector similar to that shown in FIGS. 2A and 2B with the exception that the electrically insulative outer shell according to this design is formed of two symmetrical shell members 17 and 18 detachably fastened together. One shell member 17 has locating holes 171. The other shell member 18 has hooks (not shown) respectively hooked in the locating holes 171. Because the locating holes 171 are exposed to the outside, they obstruct the sense of beauty of the connector.

Therefore, it is desirable to provide a Serial ATA interface connector that eliminates the aforesaid drawbacks.

SUMMARY OF THE INVENTION

The present invention has been accomplished under the circumstances in view. It is therefore the main object of the present invention to provide a Serial ATA interface connector, which eliminates the procedure of soldering to connect the conductors to the terminals. It is another object of the present invention to provide a Serial ATA interface connector, which keeps the terminals and the conductors in position, preventing interference. It is still another object of the present invention to provide a Serial ATA interface connector, which keeps the outside wall in contact without opening, causing a sense of beauty. To achieve these and other objects and according to one aspect of the present invention, the Serial ATA interface connector comprises a connector body, the connector body comprising a plurality of terminal holes longitudinally extended through a rear side thereof, two top locating blocks upwardly protruded from a top wall thereof near the rear side, and two bottom locating blocks downwardly protruded from a bottom wall thereof near the rear side; a plurality of terminals respectively mounted in the terminal holes of the connector body, the terminals including short terminals and long terminals alternatively arranged in parallel, the terminals each having a rear end extended out of the rear side of the connector body and terminating in a vertically extended conductor holder, the conductor holder having an upwardly extended Y-shaped retaining notch; a bottom cover shell, the bottom cover shell comprising a cable chamber, two locating holes adapted to receive the bottom locating blocks of the connector body, a plurality of terminal slots adapted to accommodate the conductor holders of the terminals, a plurality of upright guide rods symmetrically disposed at two opposite lateral sides, two recessed portions longitudinally disposed at two opposite lateral sides, and a plurality of upright hooks; a Serial ATA interface cable inserted into the cable chamber of the bottom cover shell, the Serial ATA interface comprising a plurality of conductors respectively engaged into the Y-shaped retaining notches of the conductor holders of the terminals; and a top cover shell covered on the bottom cover shell to hold down the connector body and the Serial ATA interface cable, the top cover shell comprising a cable chamber adapted to accommodate the Serial ATA interface cable, two locating holes adapted to receive the top locating blocks of the connector body, a plurality of guide holes adapted to receive the upright guide rods of the bottom cover shell, a plurality of hook holes adapted to receive the upright hooks of the bottom cover shell, and two protruding portions adapted to engage the recessed portions of the bottom cover shell. According to another aspect of the present invention, the locating holes, positioning holes, guide holes, and hook holes of the top cover shell are formed in an inside wall of the top cover shell and kept from sight after connection of the top cover shell to the bottom cover shell.

DETAILED DESCRIPTION OF THE PREFERRED EMBODIMENT

Figure 1:
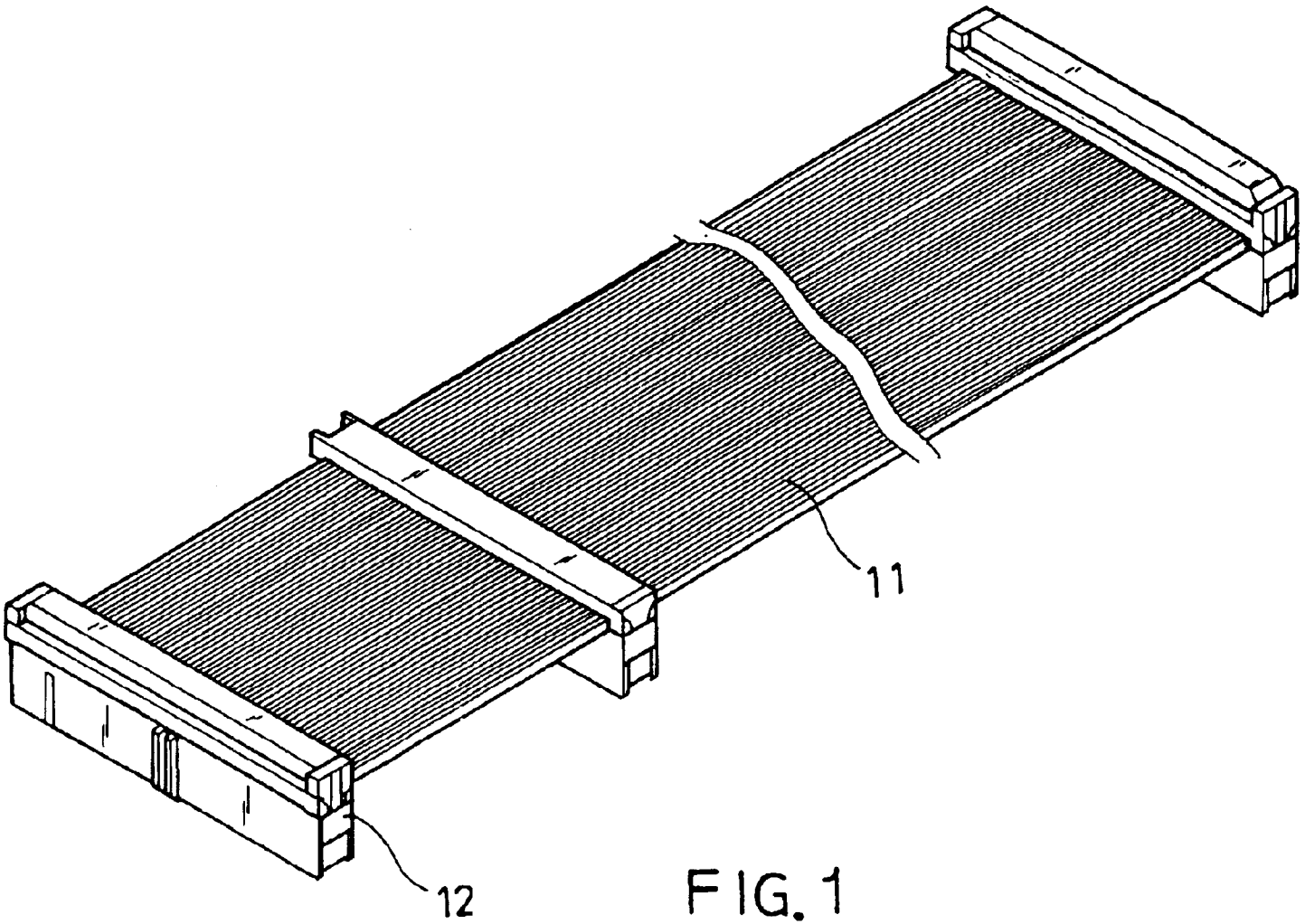
FIG. 1 (PRIOR ART)
FIG. 1 is a bus line connector according to the prior art.
Figure 2A:
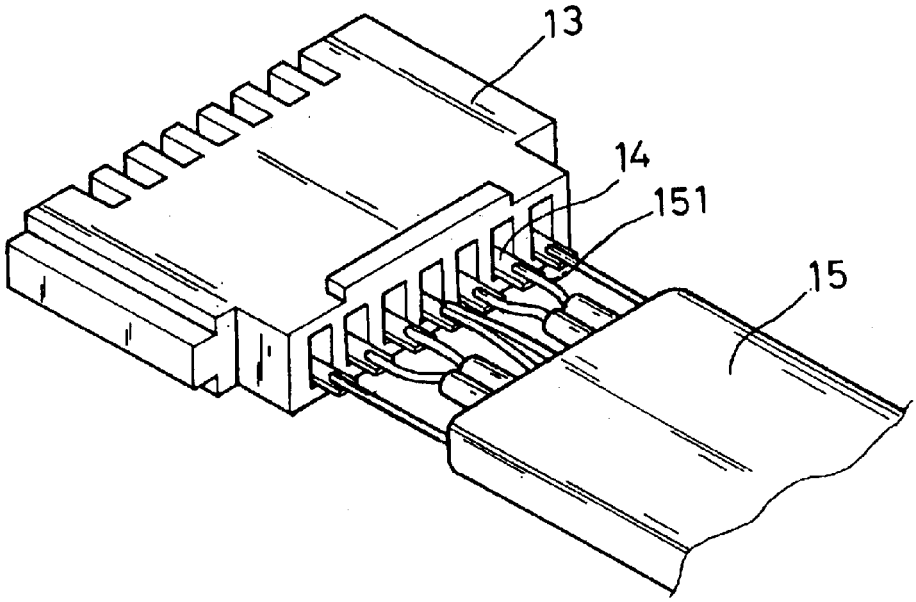
FIG. 2(A) (PRIOR ART)
FIG. 2A illustrates a Serial ATA interface cable connected to a connector body for Serial ATA interface connector according to the prior art.
Figure 2B:
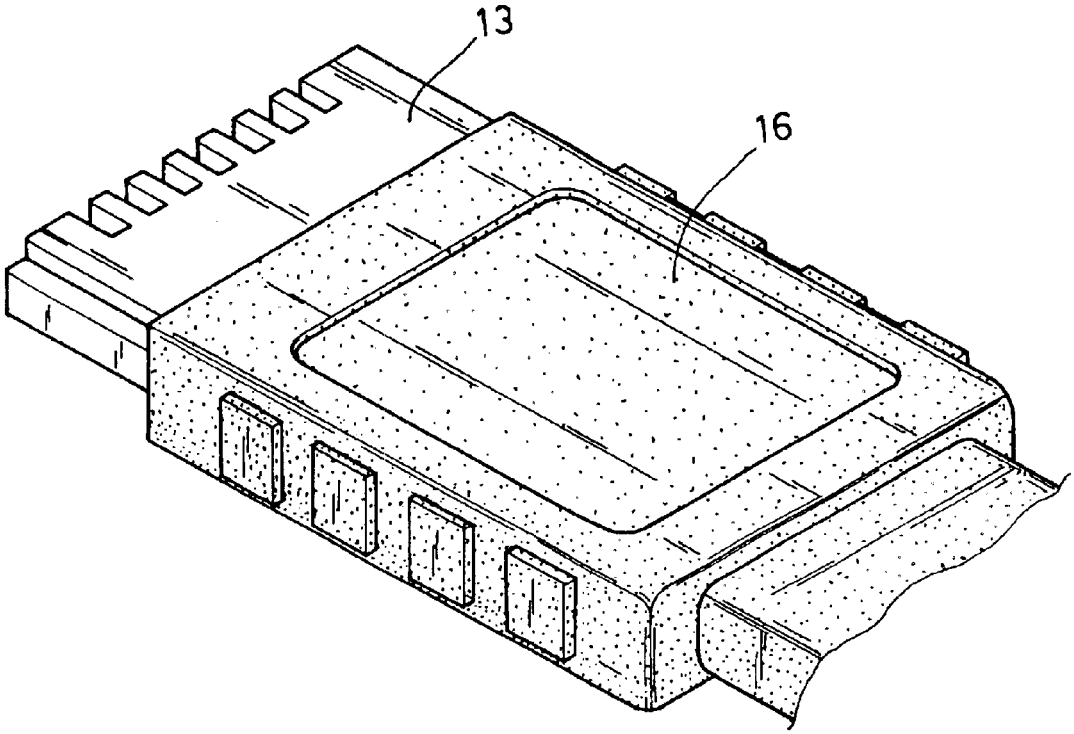
FIG. 2(B) (PRIOR ART)
FIG. 2B is an elevational view of a Serial ATA interface connector according to the prior art.
Figure 2C:
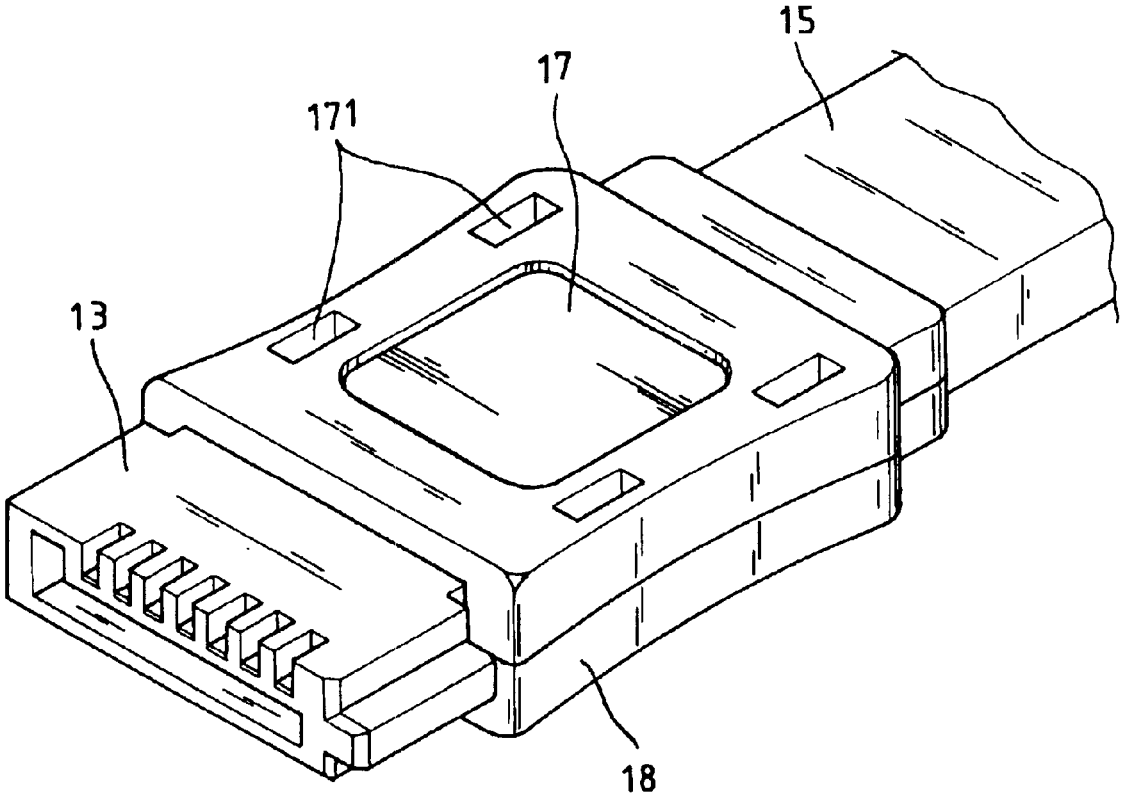
FIG. 2(C) PRIOR ART
FIG. 2C is an elevational view of another prior art Serial ATA interface connector.
Figure 3:
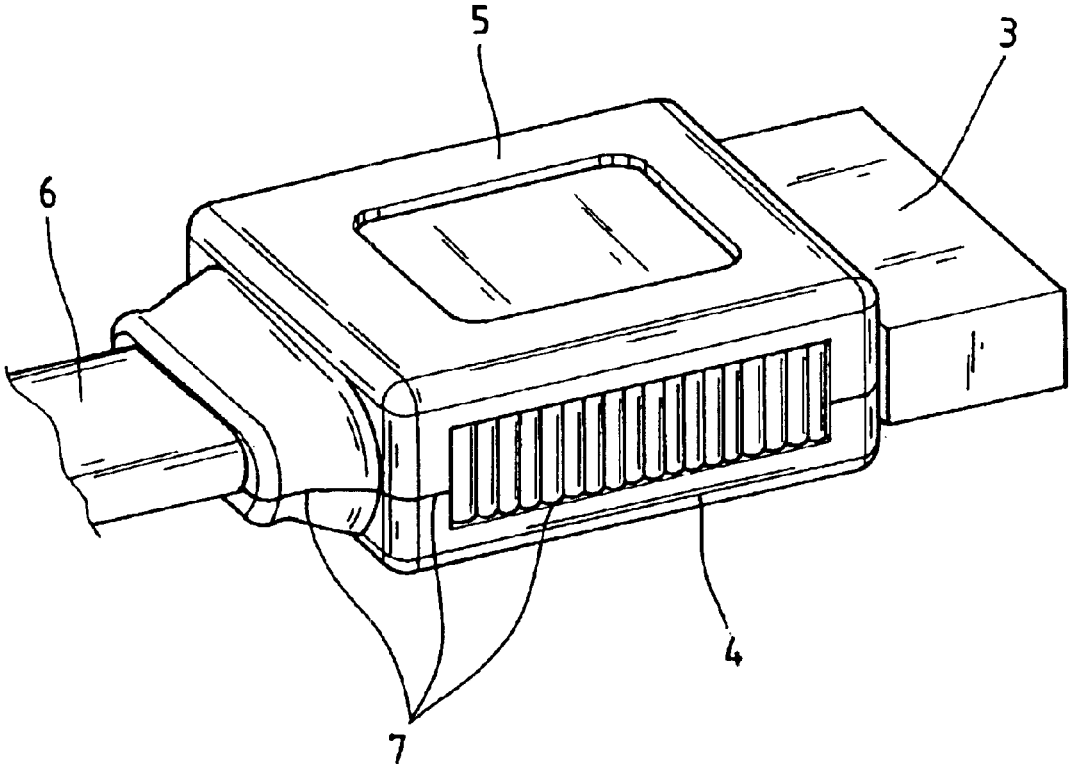
FIG. 3 is an elevational view of a Serial ATA interface connector according to the present invention.
Figure 4:
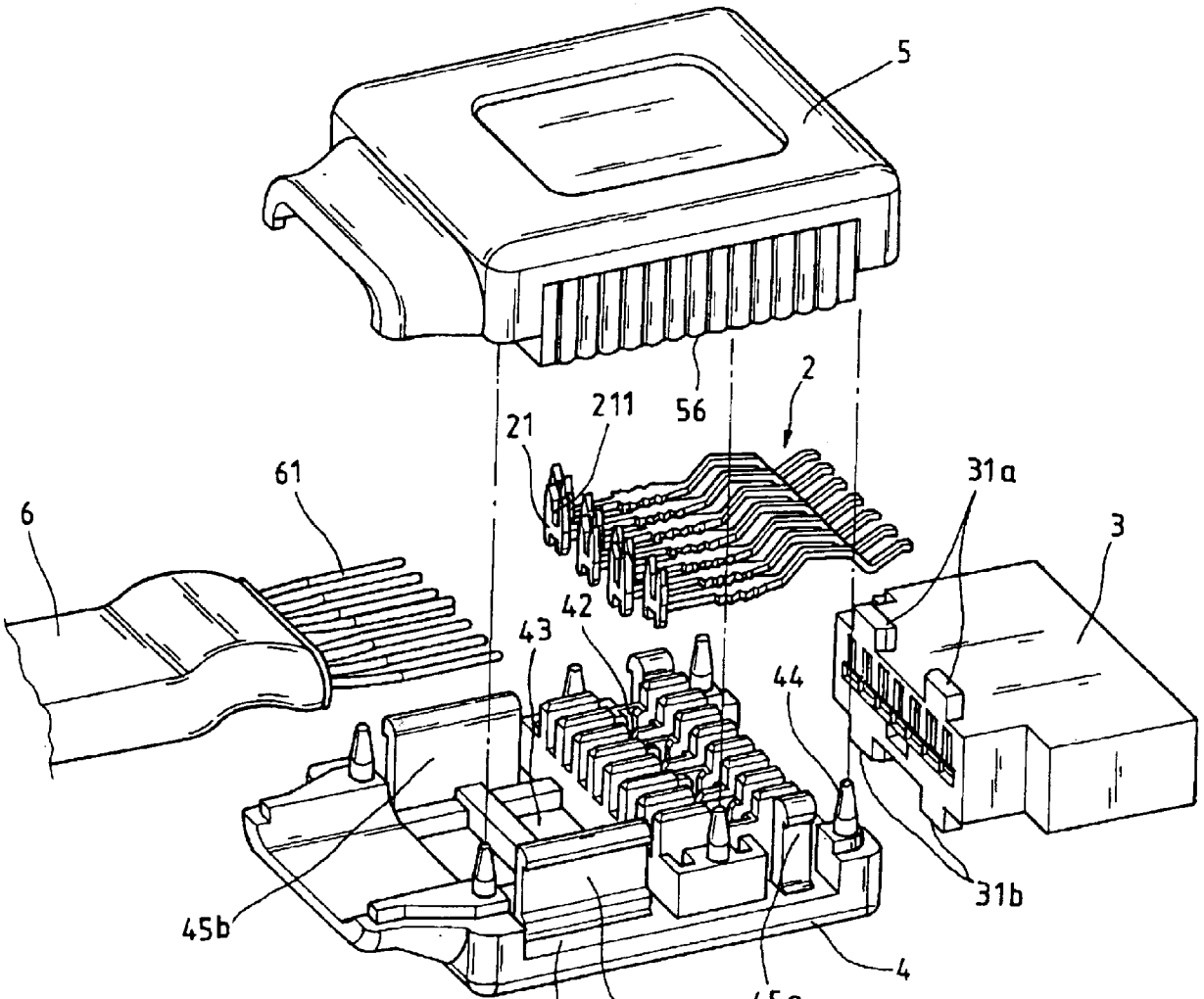
FIG. 4 is an exploded view of the Serial ATA interface connector according to the present invention.
Figure 5:
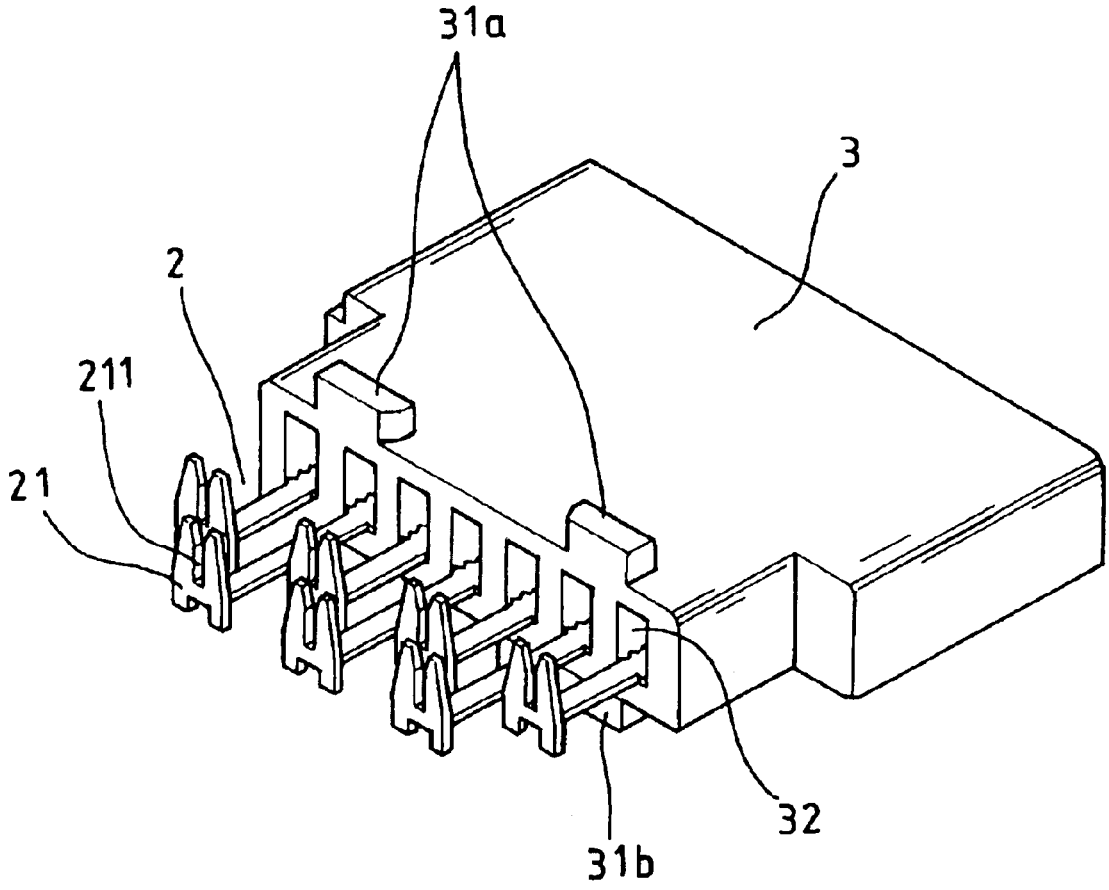
FIG. 5 is an oblique rear elevation of a part of the present invention, showing the terminals installed in the connector body.

Referring to FIGS. 3~5, a Serial ATA interface connector is shown comprised of a set of terminals 2, a connector body 3, a bottom cover shell 4, and a top cover shell 5. The terminals 2 are respectively mounted in the connector body 3. The bottom cover shell 4 has two locating holes 41 disposed near one end, a plurality of terminal slots 42 adapted to receive the terminals 2, a cable chamber 43 adapted to receive the conductors 61 of a Serial ATA interface cable 6, two pairs of upright hooks 45*a* and 45*b* disposed near two opposite lateral sides, and a plurality of upright guide rods 44.

The terminals 2 are respectively mounted in respective terminal holes 32 in the connector body 3, each having an outer end terminating in a vertically extended conductor holder 21, which defines an upwardly extended and substantially Y-shaped retaining notch 211. The conductor holders 21 of the terminals 2 are respectively positioned in the terminal slots 42 of the bottom cover shell 4. The terminals 2 include relatively longer first terminals and relatively shorter second terminals. The first and second terminals 2 are alternatively arranged in parallel. The conductors 61 of the Serial ATA interface cable 6 are respectively engaged into the Y-shaped retaining notches 211 of the terminals 2 (the two middle grounding conductors of the SATA interface cable 6 are fastened to the Y-shaped retaining notch 211 of one common terminal.

Figure 6:
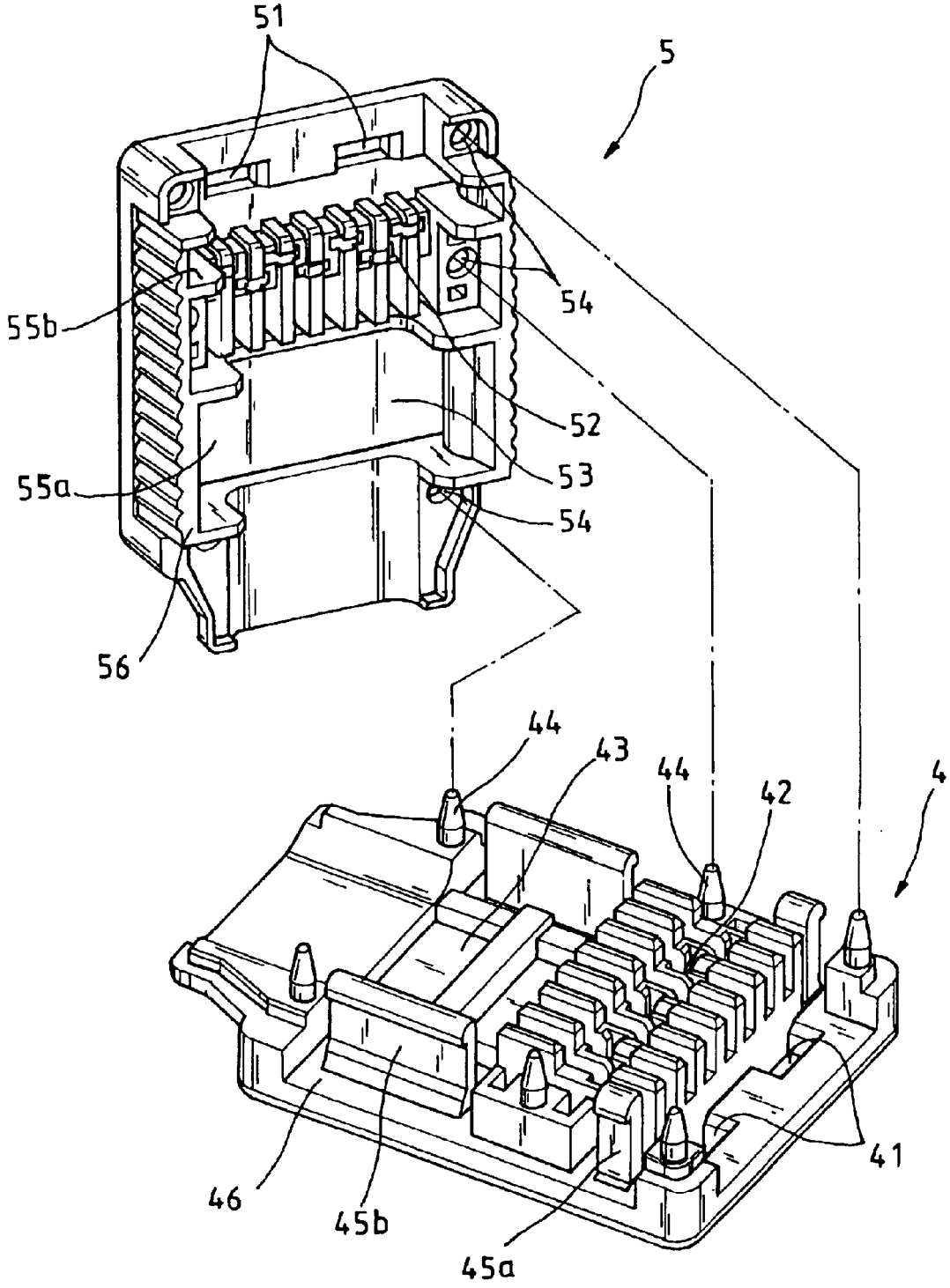
FIG. 6 is elevational view of terminals for the Serial ATA interface connector according to the present invention.

Referring to FIG. 6 and FIG. 4 again, the top cover shell 5 is covered on the bottom cover shell 4, having two locating holes 51 disposed near one end corresponding to the locating holes 41 of the bottom cover shell 4, a cable chamber 53 adapted to accommodate the conductors 61 of the SATA interface cable 6, a plurality of hook holes 55*a* and 55*b* respectively forced into engagement with the upright hooks 45*a* and 45*b* of the bottom cover shell 4, and a plurality of guide holes 54 adapted to receive the upright guide rods 44 of the bottom cover shell 4. The connector body 3 is sandwiched in between the bottom cover shell 4 and the top cover shell 5, having top and bottom locating blocks 31*a* and 31*b* respectively engaged into the locating holes 51 of the top cover shell 5 and the locating holes 41 of the bottom cover shell 4.

Figure 7:
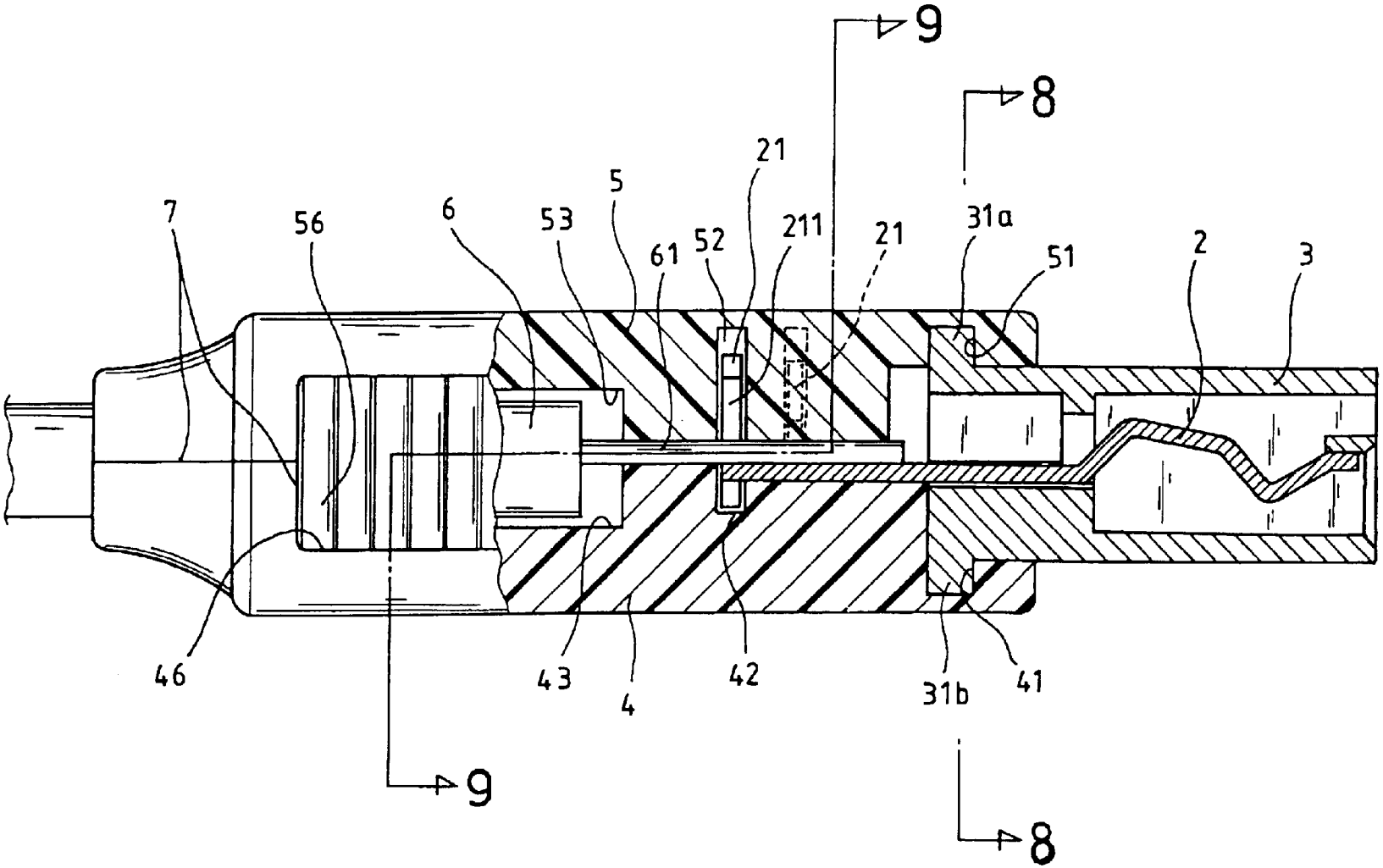
FIG. 7 is a side view in section in enlarged scale of the Serial ATA interface connector according to the present invention.

Referring to FIG. 7, the terminals 2 have the respective front ends respectively received inside the connector body 3 and the respective vertically extended conductor holders 21 respectively positioned in the terminal slots 42 of the bottom cover shell 4; the conductors 61 of the Serial ATA interface cable 6 are respectively fastened to the Y-shaped retaining notches 241 of the conductor holders 21 of the terminals 2. The top cover shell 5 further has a plurality of positioning holes 52 adapted to accommodate the vertically extended conductor holders 21 of the terminals 2. Therefore, the conductors 61 of the Serial ATA interface cable 6 are respectively fastened to the terminals 2 without solder. After installation of the terminals 2 in the connector body 3, the conductor holders 21 of the terminals 2 are alternatively aligned in two rows, preventing interference or accidental contact between each two adjacent conductors 61. Therefore, the invention greatly improves the yielding of the fabrication of Serial ATA interface connectors. Because the conductor holders 21 of the terminals 2 are kept in vertical, the conductors 61 are maintained in horizontal without bending when connected to the terminals 2, preventing signal loss.

Figure 8:
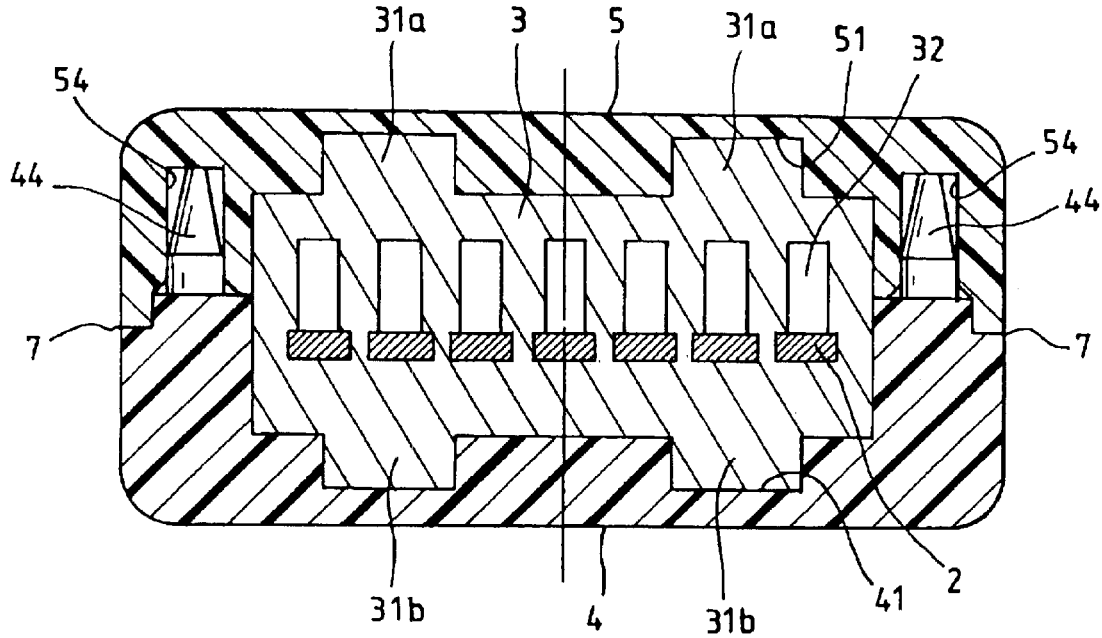
FIG. 8 is a sectional view taken along line 8—8 of FIG. 7.
Figure 9:
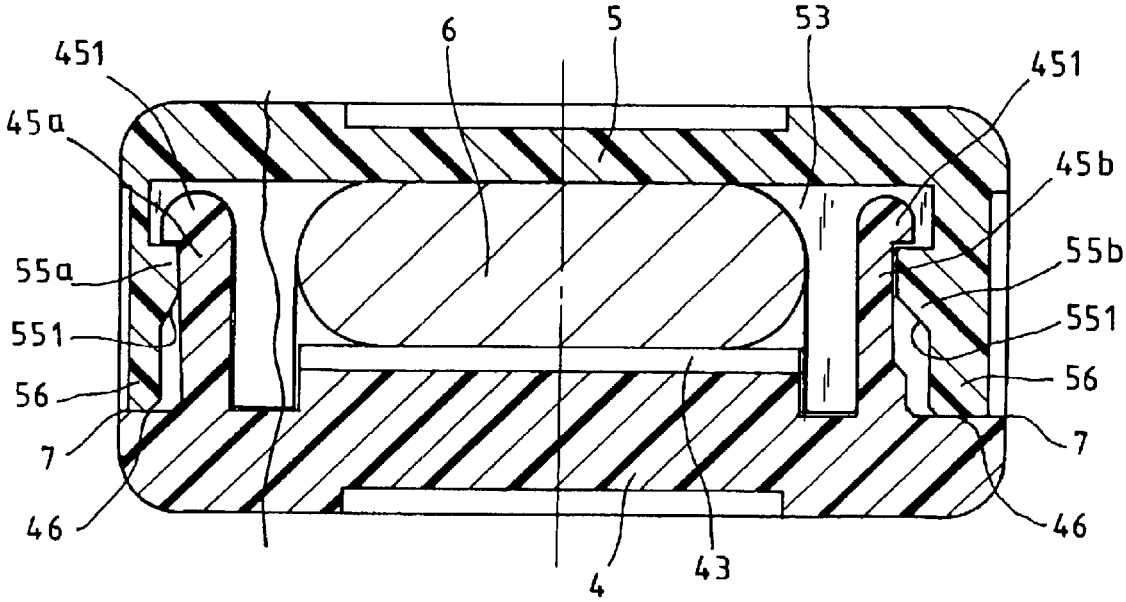
FIG. 9 is a sectional view taken along line 9—9 of FIG. 8.

Referring to FIGS. 8 and 9 and FIGS. 6 and 7 again, the upright guide rods 44 of the bottom cover shell 4 are respectively aimed at the guide holes 54 of the top cover shell 5 for enabling the upright hooks 45*a* and 45*b* to be rapidly and accurately hooked in the respective hook holes 55*a* and 55*b* of the top cover shell 5 when fastening the bottom cover shell 4 and the top cover shell 5. The bottom cover shell 4 further comprises two recessed portions 46 symmetrically longitudinally disposed at two opposite lateral sides. The top cover shell 5 further comprises two protruded portions 56 respectively engaged into the recessed portions 46 of the bottom cover shell 4 to prevent relative displacement between the top cover shell 5 and the bottom cover shell 4.

Referring to FIGS. 4, 5 and 9 again, the locating holes 51, positioning holes 52, guide holes 54, and hook holes 55*a* and 55*b* of the top cover shell 5 are formed in the inside wall of the top cover shell 5 without cutting through the outer surface of the top cover shell 5. Therefore, the locating holes 51, positioning holes 52, guide holes 54, and hook holes 55*a* and 55*b* of the top cover shell 5 are kept from sight.

A prototype of Serial ATA interface connector has been constructed with the features of the annexed drawings of FIGS. 3~9. The SATA interface connector functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A Serial ATA interface connector comprising:

a connector body, said connector body comprising a plurality of terminal holes longitudinally extended through a rear side thereof, two top locating blocks upwardly protruded from a top wall thereof near the rear side, and two bottom locating blocks downwardly protruded from a bottom wall thereof near the rear side;

a plurality of terminals respectively mounted in the terminal holes of said connector body, said terminals including short terminals and long terminals alternatively arranged in parallel, said terminals each having a rear end extended out of the rear side of said connector body and terminating in a vertically extended conductor holder, said conductor holder having an upwardly extended Y-shaped retaining notch;

a bottom cover shell, said bottom cover shell comprising a cable chamber, two locating holes adapted to receive the bottom locating blocks of said connector body, a plurality of terminal slots adapted to accommodate the conductor holders of said terminals, a plurality of upright guide rods symmetrically disposed at two opposite lateral sides, two recessed portions longitudinally disposed at two opposite lateral sides, and a plurality of upright hooks;

a Serial ATA interface cable inserted into the cable chamber of said bottom cover shell, said Serial ATA interface comprising a plurality of conductors respectively engaged into the Y-shaped retaining notches of the conductor holders of said terminals; and a top cover shell covered on said bottom cover shell to hold down said connector body and said Serial ATA interface cable, said top cover shell comprising a cable chamber adapted to accommodate said Serial ATA interface cable, two locating holes adapted to receive the top locating blocks of said connector body, a plurality of guide holes adapted to receive the upright guide rods of said bottom cover shell, a plurality of hook holes adapted to receive the upright hooks of said bottom cover shell, and two protruding portions adapted to engage the recessed portions of said bottom cover shell.

2. The Serial ATA interface connector as claimed in claim 1, wherein the locating holes, positioning holes, guide holes, and hook holes of said top cover shell are formed in an inside wall of said top cover shell and kept from sight after connection of said top cover shell to said bottom cover shell.

* * * * *